US008424134B2

(12) United States Patent
Byun

(10) Patent No.: US 8,424,134 B2
(45) Date of Patent: Apr. 23, 2013

(54) MEDICAL BED

(75) Inventor: Deok-Gyu Byun, Daejeon (KR)

(73) Assignee: Sor Bed Co., Ltd, Changup Boyuk Center, Korea, Polytechnic IV Colleges, Gayang-Dong, Dong-Gu, Daejeon (KR)

( * ) Notice: Subject to any disclaimer, the term of this patent is extended or adjusted under 35 U.S.C. 154(b) by 291 days.

(21) Appl. No.: 12/998,064

(22) PCT Filed: Sep. 8, 2009

(86) PCT No.: PCT/KR2009/005072

§ 371 (c)(1),
(2), (4) Date: Mar. 14, 2011

(87) PCT Pub. No.: WO2010/035968

PCT Pub. Date: Apr. 1, 2010

(65) Prior Publication Data

US 2011/0162143 A1 Jul. 7, 2011

(30) Foreign Application Priority Data

Sep. 26, 2008 (KR) ..... 10-2008-0094997
Jul. 28, 2009 (KR) ..... 10-2009-0069104

(51) Int. Cl.
*A61G 7/02* (2006.01)
*A61G 7/015* (2006.01)
*A47C 23/06* (2006.01)

(52) U.S. Cl.
USPC ..... 5/604; 5/606; 5/613; 5/614; 5/236.1; 5/241

(58) Field of Classification Search ..... 5/604–606, 5/600, 613, 614, 236.1, 239, 241
See application file for complete search history.

(56) References Cited

U.S. PATENT DOCUMENTS

| | | | | | |
|---|---|---|---|---|---|
| 818,821 | A * | 4/1906 | Feely | 4/480 |
| 3,757,355 | A * | 9/1973 | Allen et al. | 5/604 |
| 5,054,136 | A * | 10/1991 | Inagaki | 4/546 |
| 5,060,326 | A * | 10/1991 | Oswald | 5/236.1 |
| 5,109,558 | A * | 5/1992 | Di Blasi | 5/611 |
| 5,210,889 | A * | 5/1993 | Wesemann et al. | 5/236.1 |
| 5,265,290 | A * | 11/1993 | Van Raemdonck | 5/236.1 |
| 5,513,404 | A * | 5/1996 | Kanai | 5/604 |
| 5,926,875 | A * | 7/1999 | Okamoto et al. | 5/605 |
| 6,671,901 | B2 * | 1/2004 | Zenczykowski | 5/118 |
| 6,708,353 | B2 * | 3/2004 | Han | 5/632 |
| 7,178,183 | B2 * | 2/2007 | Cho | 5/421 |
| 2003/0126684 | A1 * | 7/2003 | Han | 5/630 |
| 2005/0229319 | A1 * | 10/2005 | Cho | 5/690 |
| 2010/0083441 | A1 * | 4/2010 | Ishida | 5/604 |
| 2011/0162143 | A1 * | 7/2011 | Byun | 5/604 |

* cited by examiner

*Primary Examiner* — Robert G Santos
(74) *Attorney, Agent, or Firm* — GWiPS

(57) ABSTRACT

A medical bed has developed, comprising a lifting unit extended to the lower body unit with an insertion unit mounted on an elastic spring for applying pressure to a lifting member, a water collection unit positioned at inner room of the bed frame forming sloped bottom surface, an angle adjustment unit installed at the bed frame for angular movement of the bed frame, a plural of the loess bed units, a separation preventing unit for preventing separation of the loess bed unit and a support plate for supporting the loess bed unit. The body unit extends the lower head unit and guides vertical movement of the loess bed. The lifting member installed on a fastening bar for controlling the lifting unit. The elastic spring is arranged inside of the lifting member, and an inlet-outlet for injecting and discharging pneumatic and hydraulic pressure formed at the upper lifting member.

20 Claims, 9 Drawing Sheets

MEDICAL BED

BACKGROUND OF THE INVENTION

1. Field of the Invention

The present invention relates to a medical bed, which is used by a patient for lying down and contacting to an upper surface of the bed for a long time, so that it is necessary to prevent the bedsore, when the patient remains in the bed quite a long time. Therefore, it is important to assure the air circulating underneath the patient's back, periodically to have the smooth blood circulation for the patient's back. Thereby, the patient, who is bedridden for quite long periods, is able to get rid of the bedsores, consequently.

2. Description of the Related Prior Arts

In general, serious cases who cannot move on their own, including elderly patients, weak patients, general (or local) paralysis patients, and other benumbed patients, essentially require assistance of a nurse or a caregiver for bathing and going to the bathroom.

Further, since bedsores may occur in patients who do not change their posture at least every 2 to 3 minutes, it is necessary to change a posture per a predetermined time interval or to keep the skin clean and dry while providing sufficient nutrition.

Thus, there is a serious demand for development of a patient bathing bed which assures easy bathing of the body of a patient and easy change in the posture of the patient to prevent bedsores.

Korean Utility Model Registration No. 20-0401864 is well known as one example of the related art to solve the above described problems.

In the disclosure of the above registration, a bed frame is vertically movably fabricated, and actuators are provided to enable angle adjustment and split rotation of an upper plate above the bed frame and an upper plate frame to support the upper plate. Free vertical movement of the bed frame is possible, which enables more efficient bathing of the body of a patient in a more convenient manner. Further, split rotation of the upper plate provides easy change in the position and orientation of the patient without forcibly rotating or bending the body of the patient.

However, the above described related art suffers from inconvenience due to a wet bed sheet used for bathing needing to be replaced with a new sheet or the sheet needs to be dried, requiring a separate apparatus and consuming considerable time.

Although a person has to carry a wet sheet in order to dry the sheet on a rooftop or in sunlight, the wet sheet is very heavy, causing physical burden and inconvenience to return the dried sheet again.

In addition, moving the patient to a shower room for bathing requires much labor of a nurse or a caregiver, causing physical burden and fatigue. Moreover, forcibly moving the patient may cause the patient pain or force the patient to assume an uncomfortable posture.

As another example of the related art, Korean Utility Model Registration No. 20-0732559 is well known.

In the disclosure of the above registration, air is injected in a state in which the body of a patient is tilted leftward or rightward by use of vertically movable mattress units so as to disperse pressure applied to the body of the patient, or in a state in which the central region of the body of the patient is lifted such that pressure applied to the body is dispersed throughout other body regions.

Although the above described related art allows the patient to change their posture without assistance of a nurse or a caregiver, the patient may experience discomfort because of being moved by the mattress units. Further, a space between the bed and the patient is not wide, causing the patient to frequently come into contact with the bed, which limits the ability to prevent bedsores in bedridden patients.

SUMMARY OF THE INVENTION

Therefore, the present invention has been made in view of the above problems, and it is an object of the present invention to provide a medical bed in which a space is defined between the body of a patient who lies on the bed and an upper contact surface of the bed so as to prevent bedsores occurring when the patient remains stationary for long periods of time, thereby assuring periodic air circulation beneath the body of the patient as well as smooth blood circulation in the rear portion of the patient's body and consequently, preventing disease, such as bedsores, occurring in patients who are bedridden for long periods of time.

It is another object of the present invention to provide a medical bed which can prevent a bed unit, on which a patient lies, from getting wet during bathing of the patient while assuring efficient discharge of used water, thereby enabling easy washing of the body of the patient on the bed rather than moving the patient to a remote washing place.

TECHNICAL SOLUTION

In accordance with an aspect of the present invention, the above and other objects can be accomplished by the provision of a medical bed including a bed frame defining an interior space, the bed frame being provided with legs each having a moving roller, a plurality of loess bed units, and separation preventive members provided at opposite lateral sides thereof to prevent separation of the loess bed units, a support plate installed to each of the loess bed units to support the loess bed unit, an upward or downward moving unit including a head portion attached to the support plate, a body portion extending downward from the head portion to guide upward or downward movement of the loess bed unit, and a seating portion provided at a lower end of the body portion so as to be seated on an elastic spring to apply pressure to the interior space of a lifting member, the upward or downward moving units being installed to the bed frame at a predetermined height from a bottom plane, the lifting member fastened to a fixing die to vertically move the upward or downward moving unit and configured to receive the elastic spring therein, the lifting member having an inlet hole formed at an upper position thereof through which hydraulic fluid is introduced into or discharged from the lifting member, a water collection unit located in the interior space of the bed frame and including a bottom plate inclined by a predetermined angle, the water collection unit being provided with wheels at four corners of a lower surface thereof, and an angle adjustment unit installed to the bed frame to enable angular movement of the bed frame.

In accordance with another aspect of the present invention, there is provided a medical bed including a bed frame defining an interior space, the bed frame being provided with legs each having a moving roller, a plurality of loess bed units, and separation preventive members provided at opposite lateral sides thereof to prevent separation of the loess bed units, a support plate installed to each of the loess bed units to support the loess bed unit, an upward or downward moving unit including a head portion attached to the support plate, a body portion extending downward from the head portion to guide upward or downward movement of the loess bed unit, and a pressure portion provided at a lower end of the body portion to apply pressure to the interior space of a lifting member, the upward or downward moving units being installed to the bed frame at a predetermined height from a bottom plane, the lifting member fastened to a fixing die to vertically move the upward or downward moving unit and having inlet holes formed at upper and lower positions thereof, through which hydraulic fluid is introduced into or discharged from the lifting member, a water collection unit located in the interior space of the bed frame and including a bottom plate inclined by a predetermined angle, the water collection unit being provided with wheels at four corners of a lower surface thereof, and an angle adjustment unit installed to the bed frame to enable angular movement of the bed frame.

ADVANTAGEOUS EFFECTS

As is apparent from the above description, in a medical bed in accordance with the present invention, a freely vertically movable bed unit is provided to define a space between a patient and the bed without moving the patient, in order to prevent bedsores occurring when the patient remains stationary for long periods of time. With provision of the space, periodic air circulation beneath the rear portion of the body of the patient using a blower and smooth blood circulation in the rear portion of the patient's body can be accomplished, which can prevent disease, such as bedsores, occurring in patients who are bedridden for long periods of time.

Further, the bed unit on which the patient lies is covered with a waterproof fabric so as not to get wet during bathing of the patient. This can eliminate inconvenience caused when the bed unit is replaced or is dried for a long time. Furthermore, as the water used to bathe the patient is efficiently guided to a discharge hole along a discharge plate, efficient discharge of the water from the bed can be accomplished, which can result in easy bathing of the body of the patient on the bed rather than moving the patient to a washing place. Keeping the body of the patient clean can also help to dramatically accelerate recovery.

THE DETAILED DESCRIPTION OF THE PREFERRED EMBODIMENT

Hereinafter, preferred embodiments of the present invention will be described in detail with reference to the accompanying drawings.

First Embodiment

Figure 1:
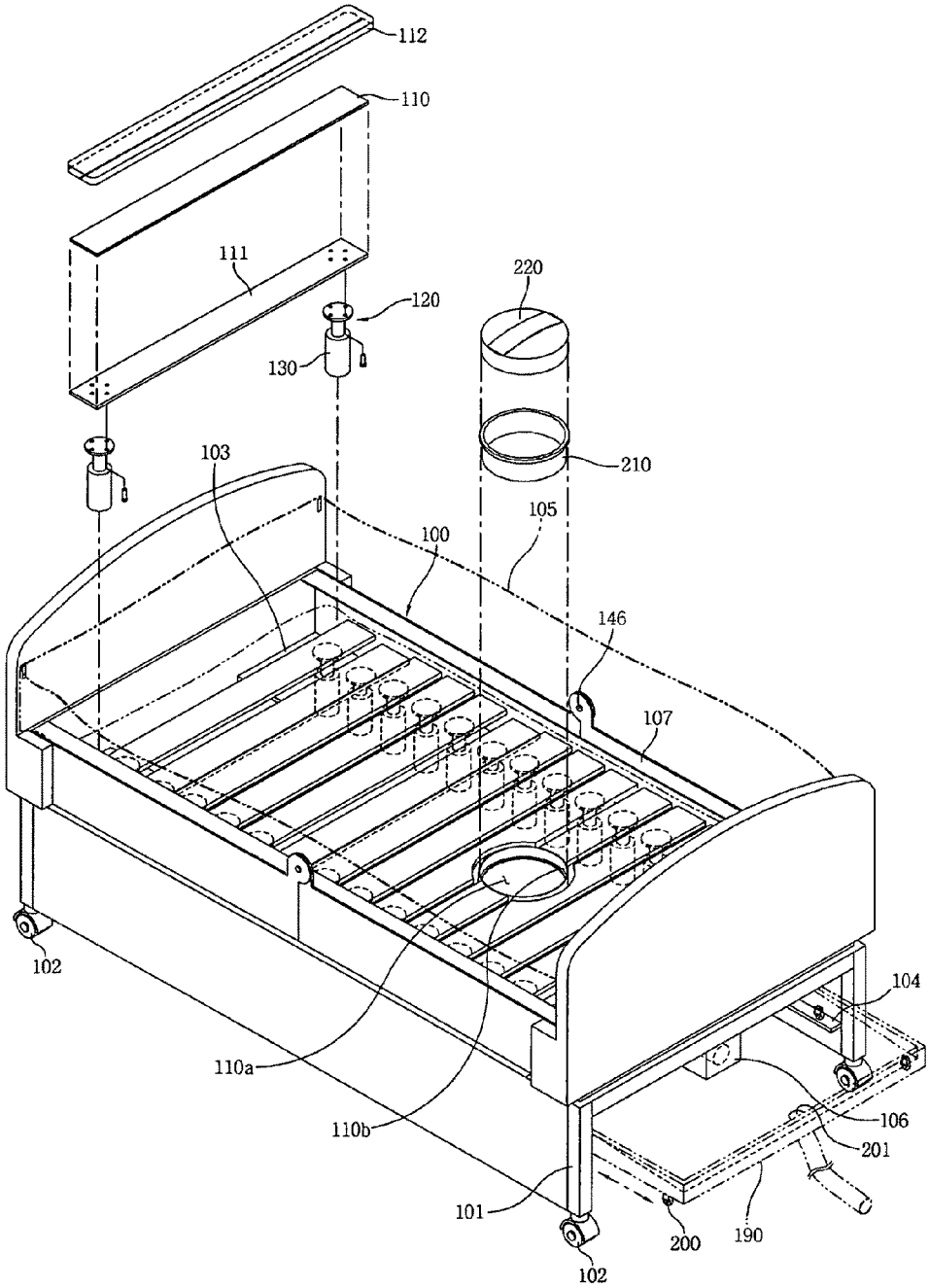
FIG. 1 is an exploded perspective view illustrating one embodiment of a medical bed in accordance with the present invention.
Figure 2:
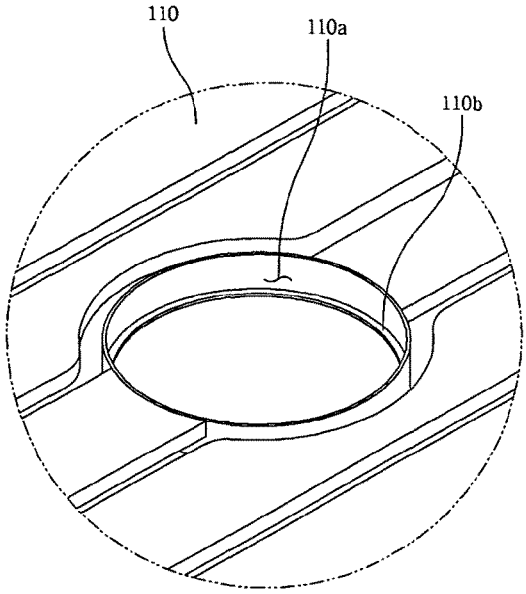
FIG. 2 is an enlarged view of an opening perforated in the medical bed in accordance with the present invention.
Figure 3:
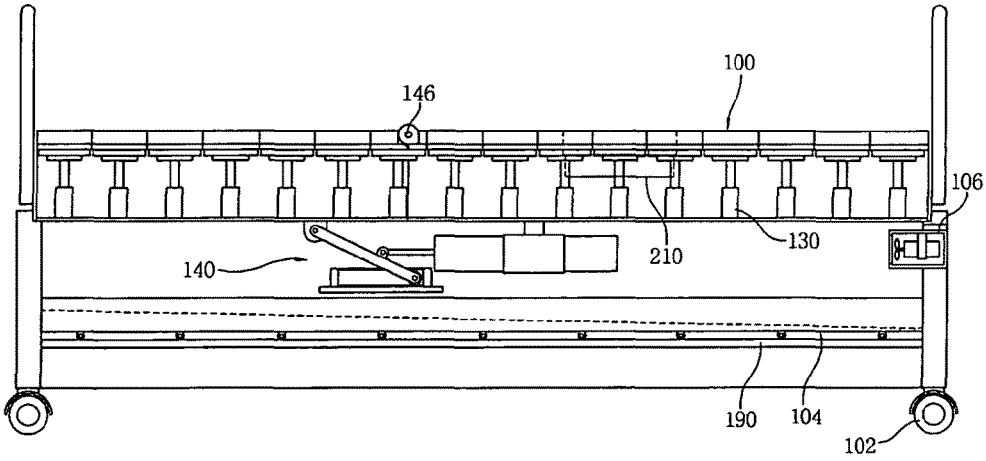
FIG. 3 is a view illustrating a state in which a bedpan is applied to the medical bed in accordance with the present invention.
Figure 4:
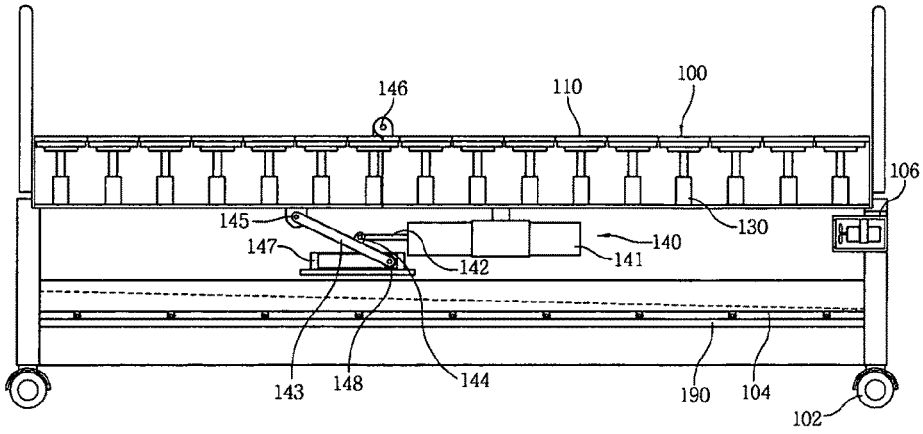
FIGS. 4 and 5 are views illustrating an operating sequence of an angle adjustment unit for use in the medical bed in accordance with the present invention.
Figure 5:
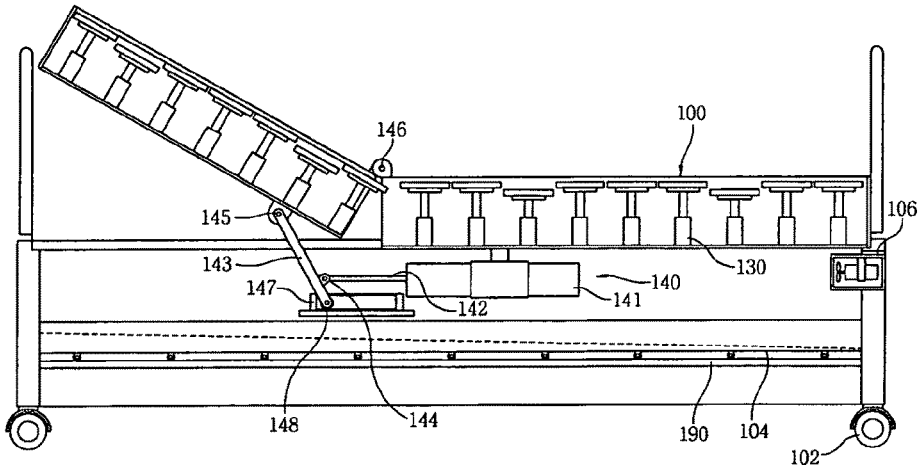
Figure 6:
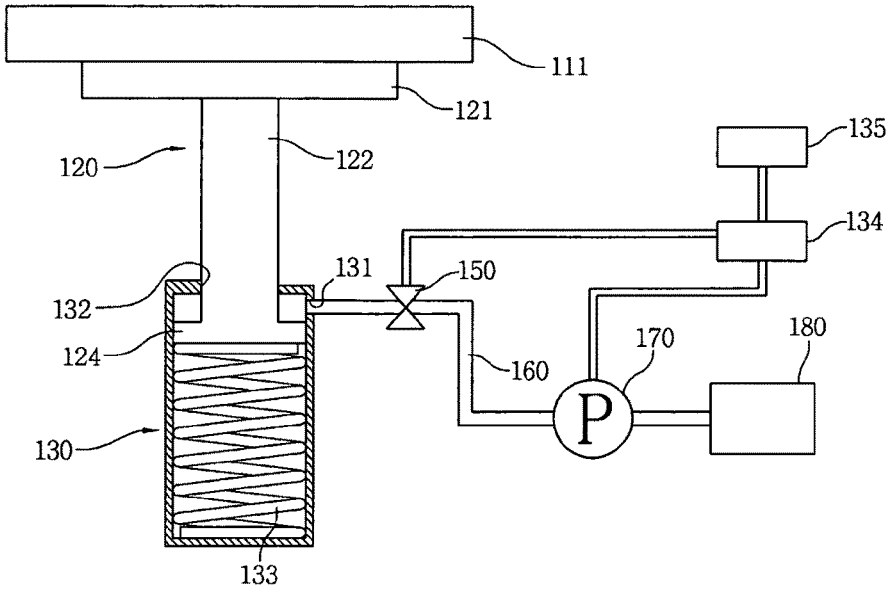
FIG. 6 is a view illustrating an upward or downward moving unit adapted to be operated by a lifting member for use in the medical bed in accordance with the present invention.
Figure 7:
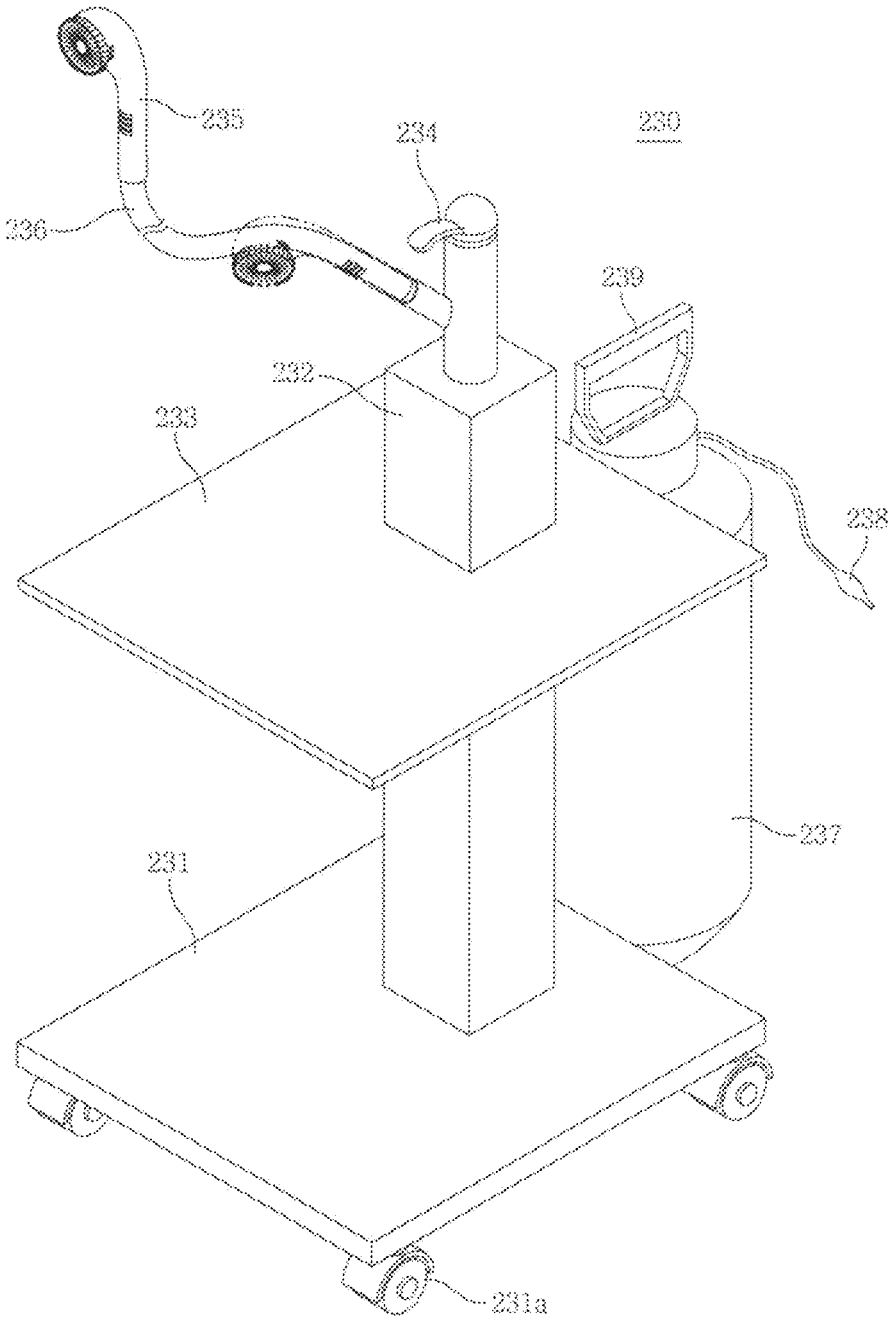
FIG. 7 is view illustrating wash water feed device usable with the medical bed in accordance with the present invention.

FIG. 1 is an exploded perspective view illustrating one embodiment of a medical bed in accordance with the present invention, FIG. 2 is an enlarged view of an opening perforated in the medical bed in accordance with the present invention, FIG. 3 is a view illustrating a state in which a bedpan is applied to the medical bed in accordance with the present invention, FIGS. 4 and 5 are views illustrating an operating sequence of an angle adjustment unit for use in the medical bed in accordance with the present invention, FIG. 6 is a view illustrating an upward or downward moving unit adapted to be operated by a lifting member for use in the medical bed in accordance with the present invention, and FIG. 7 is a view illustrating a wash water feed device usable with the medical bed in accordance with the present invention.

As illustrated in FIGS. 1 to 7, the medical bed in accordance with the present invention includes a bed frame 100, support plates 111, upward or downward moving units 120, lifting members 130, a water collection unit 190, and an angle adjustment unit 140.

The bed frame 100 includes legs 101 each provided with a moving roller 102 to enable easy movement of the bed frame 100. The bed frame 100 further includes a plurality of loess bed units 110 arranged to support the body of a patient. Loess contained in the loess bed units 110 is known as making physiological functions of cells active, generating thermal energy in the human body, and exhibiting an excellent photoelectric effect to discharge and neutralize harmful substances contained in the cells of the human body, thereby being capable of optimizing the health of the patient.

Each of the loess bed units 110 is covered with a waterproof cover 112, to prevent the loess bed unit 110 from getting wet during bathing of the patient.

The bed frame 100 further includes separation preventive members 107 provided at opposite lateral sides thereof to prevent the loess bed units 110 from being excessively moved upward during operation of the upward or downward moving units 120.

Some of the loess bed units 110, which are located in a central region of the bed, i.e. located in a region where the hips of the patient are located, centrally define an opening 110*a*. The opening 110*a* is provided at an inner circumference of a lower end thereof with a supporting rim portion 110*b*, and a loess cover 220 to open or close the opening 110*a* is seated on the supporting rim portion 110*b*. When the patient wants to go to the bathroom, the loess cover 220 is separated from the opening 110*a* to allow the patient who has difficulty moving to conveniently relieve them at the bed rather having to go to the bathroom.

In addition, a rail unit 104 is installed in an interior space of the bed frame 100 in a longitudinal direction of the bed frame 100.

The water collection unit 190, a bottom plate of which is inclined in the longitudinal direction of the bed frame 100, is located on the rail unit 104. The water collection unit 190 is provided at four corners of a lower surface with wheels 200 and a water discharge hole 201 is perforated in an end position of the inclined bottom plate of the water collection unit 190. As the water collection unit 190 is installed to easily slide inward or outward of the bed frame 100, a user can easily pull out the water collection unit 190 as necessary to remove impurities and scale.

Furthermore, owing to the fact that the bottom plate of the water collection unit 190 is inclined by a predetermined angle, water used to wash the body of the patient during bathing, dirt released from the body of the patient, excrement, and the like can be rapidly moved toward the discharge hole 201, thereby being efficiently discharged from the bed frame 100 through the discharge hole 201.

Preferably, the discharge hole 201 is connected to a discharge hose such that the dirt released from the human body, excrement, and the like are moved to a sewer system.

The bed frame 100 further includes a bath curtain 105, which is configured to be simply installed to or separated from the bed frame 100. The bath curtain 105 serves not only to shield the naked body of the patient so as to guard the privacy of the patient, but also to prevent water from scattering to the outside.

In addition, the bed frame 100 is provided with a supporting bar (not shown) to which a blowing fan 106 is installed to facilitate blood circulation of the patient so as to more efficiently prevent bedsores.

A wash water feed device 230 is installed to the bed frame 100. The wash water feed device includes a supporting pedestal 231, a vertical post 232, an operating lever 234, a shower member 235, a storage container 237, and an injection hose 238. The wash water feed device 230 allows the patient to easily shower in both a place where a water supply facility, into which water is supplied, is provided and a place where a water supply facility is not provided.

In a first example, in the place where the water supply facility is provided, the supporting pedestal 231, the vertical post 232, the operating lever 234, and the shower member 235 are used.

The supporting pedestal 231 is provided at a lower surface thereof with wheels 231*a* to enable easy movement of the wash water feed device 230. The vertical post 232 extends upward from an upper surface of the supporting pedestal 231 and is provided at a certain position thereof with a shelf 233 on which shower goods can be placed. The vertical post 232 takes the form of a hollow square bar.

The operating lever 234 is installed to an upper end of the vertical post 232 and serves to control the rate at which hot and cold water is supplied thereto. The shower member 235 is connected to a water tap (not shown) via a connection hose 236 to initiate or stop injection of the hot and cold water as the user operates the operating lever 234 upward or downward.

On the contrary, in the place where the water supply facility is not provided, the storage container 237 and the injection hose 238 may be used.

The storage container 237 is installed to the vertical post 232 and receives wash water at a predetermined water level in an interior space thereof. The injection hose 238 is installed to the storage container 237 to inject wash water.

To allow the injection hose 238 to inject the wash water received in the storage container 237, preferably, the storage container 237 is provided with a pump 239. The pump 239 serves to pump the wash water received in the storage container 237 to facilitate easy injection of the wash water through the injection hose 238.

The support plate 111 is installed to each of the loess bed units 110 and serves to support the loess bed unit 110 while guiding upward or downward movement of the loess bed unit 110.

The upward or downward moving units 120 are installed to the bed frame 100 at a predetermined height from a bottom plane. Each of the upward or downward moving units 120 includes a head portion 121, which is attached to the support plate 111 to support the support plate 111, a body portion 122, which extends downward from the head portion 121 to guide upward or downward movement of the loess bed unit 110, and a seating portion 124, which is provided at a lower end of the body portion 122 and is seated on an elastic spring 133.

The lifting members 130 serve to define a space between the loess bed units 110 and the rear portion of the human body of the patient in a state in which the patient lies on the bed, thereby enabling periodic air circulation in the space while assuring smooth blood circulation of the patient, which can prevent diseases, such as bedsores, occurring in patients who are bedridden for long periods of time. The lifting members 130 are fastened to a fixing die 103 provided in the interior space of the bed frame 100 by use of screws and bolts. Each of the lifting members 130 has an insertion hole 132 through which a part of the upward or downward moving unit 120 is inserted into the interior space of the lifting member 130. The elastic spring 133 is received in the lifting member 130 so as to support the seating portion 124. The lifting member 130 further has an inlet hole 131 near an upper end thereof such that a hydraulic fluid is injected into or discharged from the lifting member 130. The lifting member 130 serves to vertically move the upward or downward moving unit.

The elastic spring 133 normally elastically supports the upward or downward moving unit 120. Then, if the hydraulic fluid is injected into the lifting member 130 through the inlet hole 131, the hydraulic fluid acts to push the upward or downward moving unit 120 downward, thereby causing the elastic spring 133 to be compressed and providing the elastic spring 133 with restoration force. Thereby, the elastic spring 133 may act to return the upward or downward moving unit 120 to an original position thereof using the restoration force when the hydraulic fluid is discharged from the lifting member 130.

The lifting member 130 is further provided with an electronic valve 150, a pump 170, a control unit 134, and a timer 135.

The electronic valve 150 is opened or closed by the control unit 134, thereby serving to control introduction of the hydraulic fluid into the lifting member 130. The pump 170 serves to introduce the hydraulic fluid stored in a hydraulic fluid device 180 into the lifting member 130.

The timer 135 is provided to allow the hydraulic oil to be alternately introduced into a plurality of lifting members 130 at a preset time that is previously input by the user, thereby allowing a plurality of upward or downward moving units 120 to be alternately moved upward or downward. If the timer 135 sends a control signal to the control unit 134 at a preset time input by the user, the control unit 134 controls opening/closing operations of a plurality of electronic valves 150 and operation of a plurality of pumps 170 in response to the control signal from the timer 135. Thereby, the hydraulic fluid can be alternately introduced into the plurality of lifting members 130 installed to the bed frame 100.

In operation of the upward or downward moving unit 120, as illustrated in FIG. 6, if the pump 170 is operated to introduce the hydraulic fluid stored in the hydraulic fluid device 180 into the lifting member 130 through the inlet hole 131 formed near the upper end of the lifting member 130, the upward or downward moving unit 120 is moved downward while compressing the elastic spring 133 with a seating portion 124 thereof. Simultaneously with the movement of the upward or downward moving unit 120, the loess bed unit 110 and the support plate 111 coupled to the head portion 121 of the upward or downward moving unit 120 are moved downward.

On the contrary, to move the upward or downward moving unit 120 upward, the electronic valve 150, which has closed the inlet hole 131 formed near the upper end of the lifting member 130, is opened to discharge the hydraulic fluid from the lifting member 130. If the electronic valve 150 is closed after the hydraulic fluid is completely discharged, the interior space of the lifting member 130 remains a vacuum and the elastic spring 133, which has been compressed to have a restoration force by the downward movement of the upward or downward moving unit 120, acts to return the upward or downward moving unit 120 to an original position thereof using the restoration force.

The angle adjustment unit 140, as illustrated in FIG. 4, includes a cylinder 141, which is installed to the bed frame 100 and is provided with a piston rod 142, a link 143, one end of which is coupled to the piston rod 142 via a first hinge 144, and the other end of which is coupled to the bed frame 100 via a second hinge 145, a supporting frame 147, which supports the link 143 and internally defines a space in which a bearing 148 is slidably installed at a position adjacent to the piston rod 142, and a third hinge 146 which is installed to a surface of the bed frame 100 to enable angular movement of the bed frame 100.

In operation of the angle adjustment unit 140, as illustrated in FIG. 5, if the hydraulic fluid is injected into the cylinder 141, the piston rod 142 is horizontally moved forward, causing the link 143, coupled to the piston rod 142 via the first hinge 144, to be vertically moved upward so as to obliquely move the bed frame 100 upward. With this vertical movement, the bed frame 100 has a predetermined inclination to lift the upper body of the patient upward. Here, the bed frame 100 can be angularly moved about the third hinge 146.

Then, if the hydraulic fluid is discharged from the cylinder 141, the piston rod 142 is returned to an original position thereof, causing the link 143 coupled to the piston rod 142 to be returned to an original position thereof. Thereby, the bed frame 100 is returned to horizontal.

Although not described above, reference numeral 160 represents a pipe for passage of the hydraulic fluid.

Second Embodiment

Figure 13:
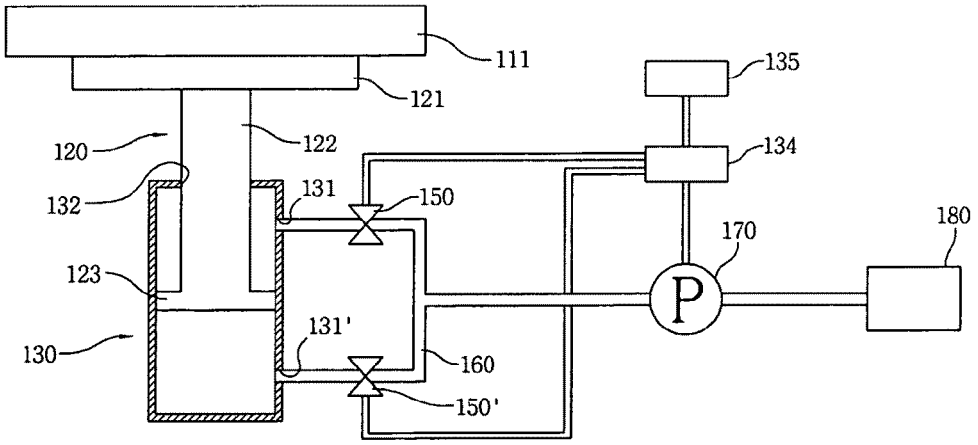
FIG. 13 is a view illustrating an upward or downward moving unit adapted to be operated by a lifting member for use in the medical bed in accordance with the present invention.
Figure 8:
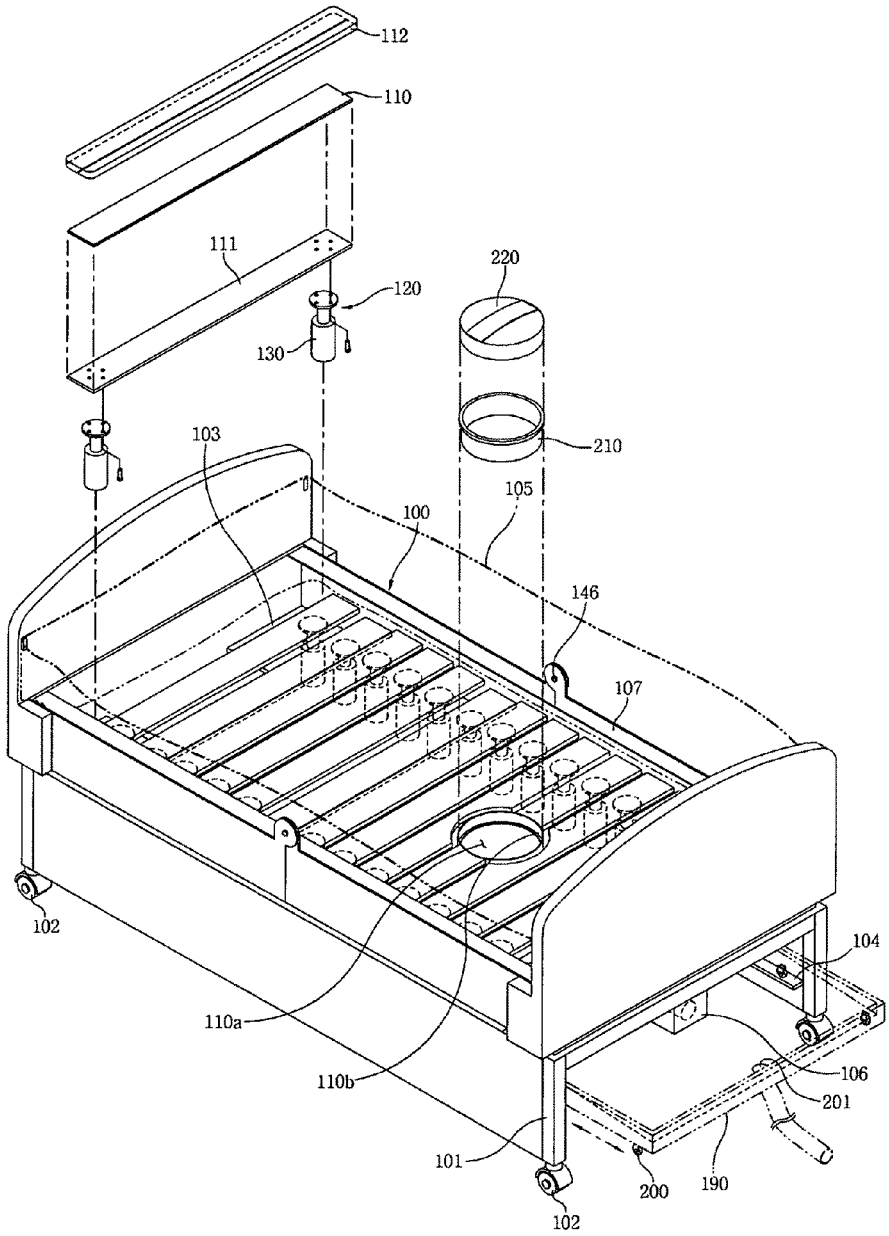
FIG. 8 is an exploded perspective view illustrating another embodiment of a medical bed in accordance with the present invention.
Figure 9:
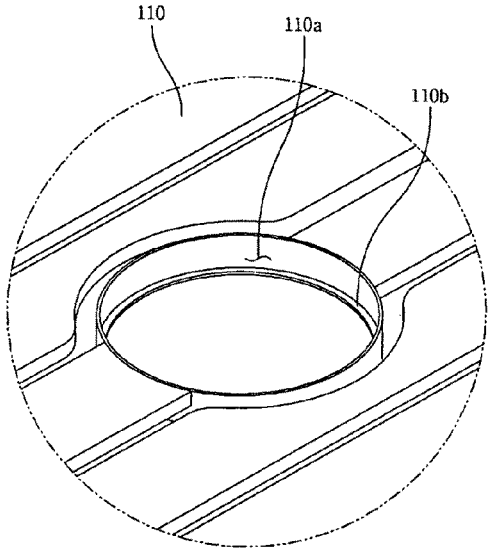
FIG. 9 is an enlarged view of an opening perforated in the medical bed in accordance with the present invention.
Figure 10:
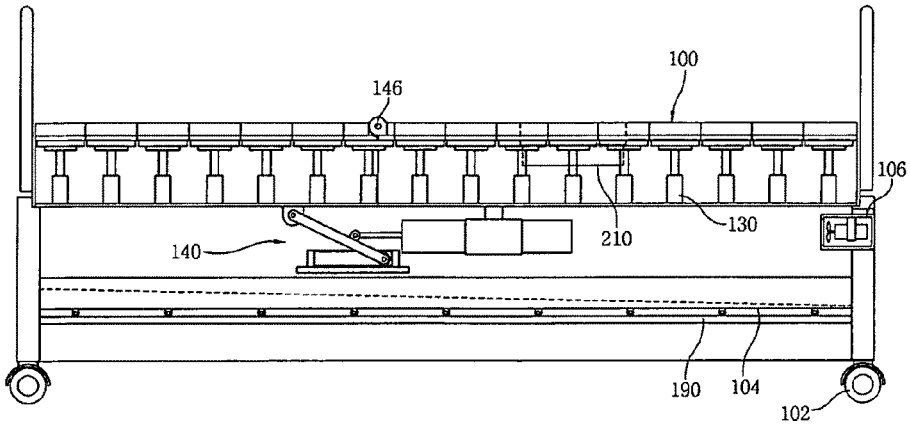
FIG. 10 is a view illustrating a state in which a bedpan is applied to the medical bed in accordance with the present invention.
Figure 11:
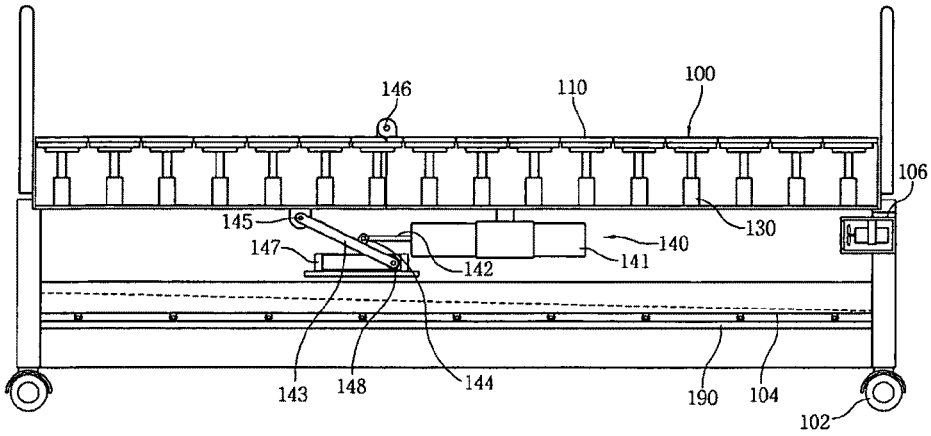
FIGS. 11 and 12 are views illustrating an operating sequence of an angle adjustment unit for use in the medical bed in accordance with the present invention.
Figure 12:
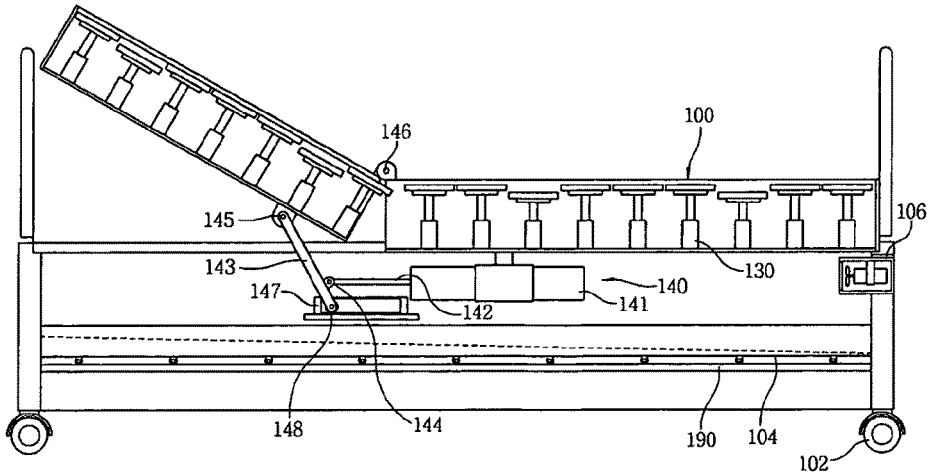
Figure 14:
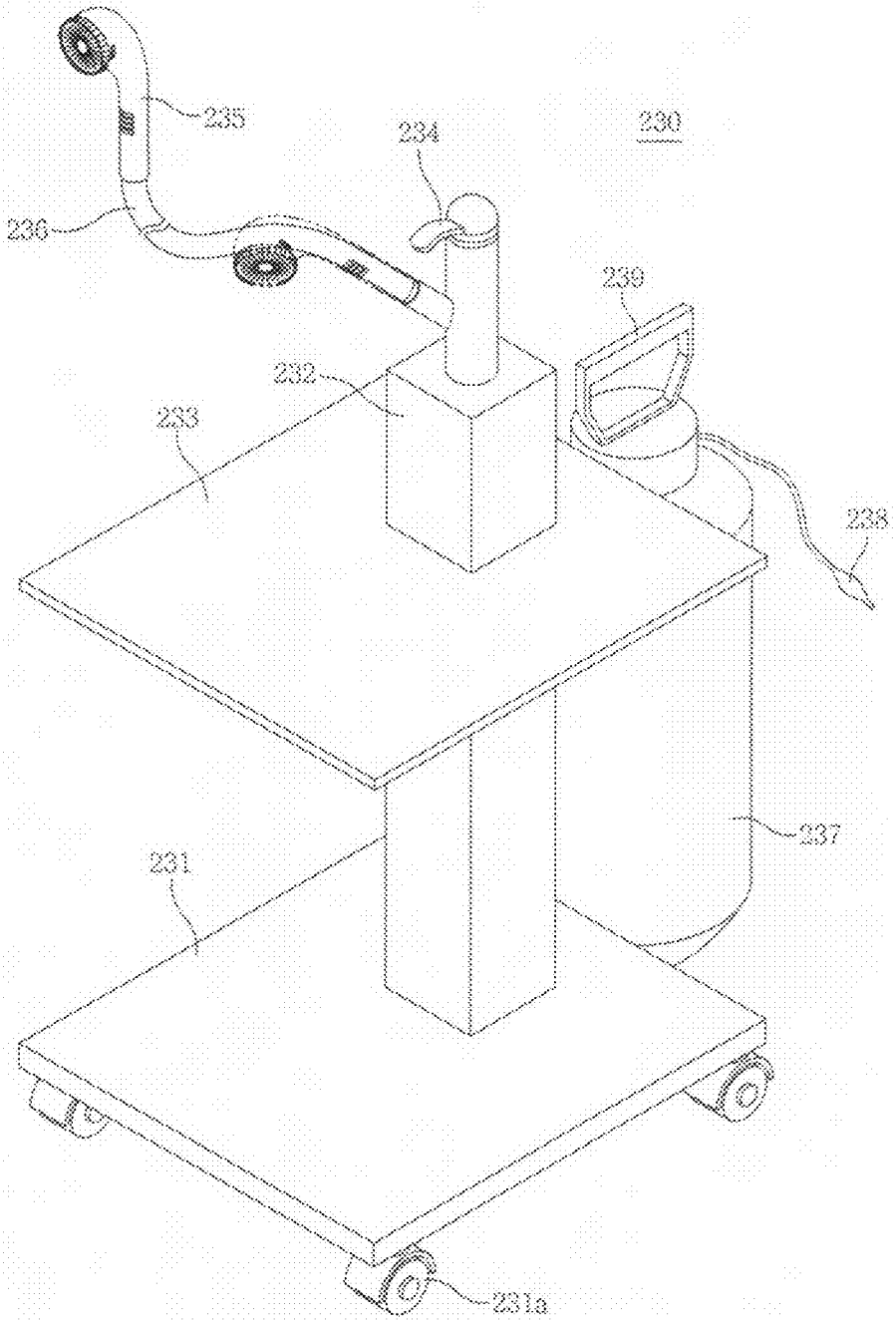
FIG. 14 is view illustrating wash water feed device usable with the medical bed in accordance with the present invention.

FIG. 8 is an exploded perspective view illustrating another embodiment of a medical bed in accordance with the present invention, FIG. 9 is an enlarged view of an opening perforated in the medical bed in accordance with the present invention, FIG. 10 is a view illustrating a state in which a bedpan is applied to the medical bed in accordance with the present invention, FIGS. 11 and 12 are views illustrating an operating sequence of an angle adjustment unit for use in the medical bed in accordance with the present invention, FIG. 13 is a view illustrating an upward or downward moving unit adapted to be operated by a lifting member for use in the medical bed in accordance with the present invention, and FIG. 14 is a view illustrating a wash water feed device usable with the medical bed in accordance with the present invention.

As illustrated in FIGS. 8 to 14, the medical bed in accordance with the present invention includes the bed frame 100, the support plates 111, the upward or downward moving units 120, the lifting members 130, the water collection unit 190, and the angle adjustment unit 140.

The bed frame 100 includes the legs 101 each provided with the moving roller 102 to enable easy movement of the bed frame 100. The bed frame 100 further includes the plurality of loess bed units 110 arranged to support the body of the patient. Loess contained in the loess bed units 110 is known as making physiological functions of cells active, generating thermal energy in the human body, and exhibiting an excellent photoelectric effect to discharge and neutralize harmful substances contained in the cells of the human body, thereby being capable of optimizing the health of the patient.

Each of the loess bed units 110 is covered with the waterproof cover 112, to prevent the loess bed unit 110 from getting wet during bathing of the patient.

The bed frame 100 further includes the separation preventive members 107 provided at opposite lateral sides thereof to prevent the loess bed units 110 from being excessively moved upward during operation of the upward or downward moving units 120.

Some of the loess bed units 110, which are located in a central region of the bed, i.e. located in a region where the hips of the patient are located, centrally define the opening 110*a*. The opening 110*a* is provided at the inner circumference of the lower end thereof with the supporting rim portion 110*b*, and the loess cover 220 to open or close the opening 110*a* is seated on the supporting rim portion 110*b*. When the patient wants to go to the bathroom, the loess cover 220 is separated from the opening 110*a* to allow the patient who has difficulty moving to conveniently relieve them at the bed rather having to go to the bathroom.

In addition, the rail units 104 are installed in an interior space of the bed frame 100 in a longitudinal direction of the bed frame 100.

The water collection unit 190, a bottom plate of which is inclined in the longitudinal direction of the bed frame 100, is located on the rail unit 104. The water collection unit 190 is provided at four corners of the lower surface thereof with the wheels 200 and the water discharge hole 201 is perforated in an end position of the inclined bottom plate of the water collection unit 190. As the water collection unit 190 is installed to easily slide inward or outward of the bed frame 100, a user can easily pull out the water collection unit 190 as necessary to remove impurities and scale.

Furthermore, owing to the fact that the bottom plate of the water collection unit 190 is inclined by a predetermined angle, water used to wash the body of the patient during bathing, dirt released from the body of the patient, excrement, and the like can be rapidly moved toward the discharge hole 201, thereby being efficiently discharged from the bed frame 100 through the discharge hole 201.

Preferably, the discharge hole 201 is connected to a discharge hose such that the dirt released from the human body, excrement, and the like are moved to a sewer system.

The bed frame 100 further includes the bath curtain 105, which is configured to be simply installed to or separated from the bed frame 100. The bath curtain 105 serves not only to shield the naked body of the patient so as to guard the privacy of the patient, but also to prevent water from scattering to the outside.

In addition, the bed frame 100 is provided with a supporting bar (not shown) to which the blowing fan 106 is installed to facilitate blood circulation of the patient so as to more efficiently prevent bedsores.

The wash water feed device 230 is installed to the bed frame 100. The wash water feed device includes the supporting pedestal 231, the vertical post 232, the operating lever 234, the shower member 235, the storage container 237, and the injection hose 238. The wash water feed device 230 allows the patient to easily shower in both a place where a water supply facility, into which water is supplied, is provided and a place where a water supply facility is not provided.

In a first example, in the place where the water supply facility is provided, the supporting pedestal 231, the vertical post 232, the operating lever 234, and the shower member 235 are used.

The supporting pedestal 231 is provided at the lower surface thereof with wheels 231*a* to enable easy movement of the wash water feed device 230. The vertical post 232 extends upward from an upper surface of the supporting pedestal 231 and is provided at a certain position thereof with the shelf 233 on which shower goods can be placed. The vertical post 232 takes the form of a hollow square bar.

The operating lever 234 is installed to an upper end of the vertical post 232 and serves to control the rate at which hot and cold water is supplied thereto. The shower member 235 is connected to a water tap (not shown) via a connection hose 236 to initiate or stop injection of the hot and cold water as the user operates the operating lever 234 upward or downward.

On the contrary, in the place where the water supply facility is not provided, the storage container 237 and the injection hose 238 may be used.

The storage container 237 is installed to the vertical post 232 via a connection member and receives wash water at a predetermined water level in an interior space thereof. The injection hose 238 is installed to the storage container 237 to inject wash water.

To allow the injection hose 238 to inject the wash water received in the storage container 237, preferably, the storage container 237 is provided with a pump 239. The pump 239 serves to pump the wash water received in the storage container 237 to facilitate easy injection of the wash water through the injection hose 238.

The support plate 111 is installed to each of the loess bed units 110 and serves to support the loess bed unit 110 while guiding upward or downward movement of the loess bed unit 110.

The upward or downward moving units 120 are installed to the bed frame 100 at a predetermined height from a bottom plane. Each of the upward or downward moving units 120 includes the head portion 121, which is attached to the support plate 111 to support the support plate 111, the body portion 122, which extends downward from the head portion 121 to guide upward or downward movement of the loess bed unit 110, and a pressure portion 123, which is provided at a lower end of the body portion 122 to apply pressure to the interior space of the lifting member 130.

The lifting members 130 serve to define a space between the loess bed units 110 and the rear portion of the body of the patient in a state in which the patient lies on the bed, thereby enabling periodic air circulation in the space while assuring smooth blood circulation of the patient, which can prevent diseases, such as bedsores, occurring in patients who are bedridden for long periods of time. The lifting members 130 are fastened to the fixing die 103 provided in the interior space of the bed frame 100 by use of screws and bolts. Each of the lifting members 130 has the insertion hole 132 through which a part of the upward or downward moving unit 120 is inserted into the interior space of the lifting member 130. The lifting member 130 further has inlet holes 131 near upper and lower ends thereof such that a hydraulic fluid is injected into or discharged from the lifting member 130. The lifting member 130 serves to vertically move the upward or downward moving unit.

The lifting member 130 is further provided with electronic valves 150 and 150', the pump 170, the control unit 134, and the timer 135.

The electronic valves 150 and 150' are opened or closed by the control unit 134, thereby serving to control introduction of the hydraulic fluid into the lifting member 130. The pump 170 serves to introduce the hydraulic fluid stored in a hydraulic fluid device 180 into the lifting member 130.

The timer 135 is provided to allow the hydraulic oil to be alternately introduced into a plurality of lifting members 130 at a preset time that is previously input by the user, thereby allowing a plurality of upward or downward moving units 120 to be alternately moved upward or downward. If the timer 135 sends a control signal to the control unit 134 at a preset time input by the user, the control unit 134 controls opening/closing operations of a plurality of electronic valves 150 and 150' and operation of a plurality of pumps 170 in response to the control signal from the timer 135. Thereby, the hydraulic fluid can be alternately introduced into the plurality of lifting members 130 installed to the bed frame 100.

In operation of the upward or downward moving unit 120, as illustrated in FIG. 7, in a state in which the electronic valve 150' is closed to prevent the hydraulic fluid from being introduced into the lifting member 130 through the inlet hole 131' near the lower end of the lifting member 130 and the electronic valve 150 is opened to allow the hydraulic fluid to be introduced into the lifting member 130 through an inlet pipe 160, if the pump 170 is operated to introduce the hydraulic fluid stored in the hydraulic fluid device 180 into the lifting member 130, the upward or downward moving unit 120 is moved downward by the hydraulic fluid and simultaneously, the loess bed unit 110 and the support plate 111 coupled to the head portion 121 of the upward or downward moving unit 120 are moved downward.

On the contrary, to move the upward or downward moving unit 120 upward, first, the electronic valve 150, which has closed the inlet hole 131 formed near the upper end of the lifting member 130, is opened to discharge the hydraulic fluid from the lifting member 130. After the hydraulic fluid is completely discharged, the electronic valve 150 is closed to prevent the hydraulic fluid from being introduced into the lifting member 130 through the inlet hole 131 formed near the upper end of the lifting member 130.

Thereafter, if the electronic valve 150' is opened to allow the hydraulic fluid to be introduced into the lifting member 130 through the inlet pipe 160 and the pump 170 is operated to introduce the hydraulic fluid into the lifting member 130, the upward or downward moving unit 120 is moved upward by the hydraulic pressure and the loess bed unit 110 and the support plate 111 coupled to the head portion 121 of the upward or downward moving unit 120 are moved upward to return to an original position thereof.

Configurations and operations of the angle adjustment unit are identical to the above description of the first embodiment and thus, a detailed description thereof is omitted.

While the present invention has been described in connection with what is presently considered to be the most practical and preferred embodiment, it is to be understood that the present invention is not limited to the disclosed embodiment and the drawings, but, on the contrary, it is intended to cover various modifications and variations within the spirit and scope of the appended claims.

What is claimed is:

1. A medical bed comprising:

a bed frame defining an interior space, the bed frame being provided with legs each having a moving roller, a plurality of loess bed units, and separation preventive members provided at opposite lateral sides thereof to prevent separation of the loess bed units;

a support plate installed to each of the loess bed units to support the loess bed unit;

an upward or downward moving unit including a head portion attached to the support plate, a body portion extending downward from the head portion to guide upward or downward movement of the loess bed unit, and a seating portion provided at a lower end of the body portion so as to be seated on an elastic spring to apply pressure to the interior space of a lifting member, the upward or downward moving units being installed to the bed frame at a predetermined height from a bottom plane;

the lifting member fastened to a fixing die to vertically move the upward or downward moving unit and configured to receive the elastic spring therein, the lifting member having an inlet hole formed at an upper position thereof through which hydraulic fluid is introduced into or discharged from the lifting member;

a water collection unit located in the interior space of the bed frame and including a bottom plate inclined by a predetermined angle, the water collection unit being provided with wheels at four corners of a lower surface thereof; and an angle adjustment unit installed to the bed frame to enable angular movement of the bed frame.

2. The medical bed according to claim 1, wherein a rail unit is further installed in the interior space of the bed frame to guide sliding of the wheels of the water collection unit.

3. The medical bed according to claim 1, wherein the bed frame is further provided with a bath curtain.

4. The medical bed according to claim 1, wherein the bed frame is further provided with a blowing fan to facilitate blood circulation of the patient.

5. The medical bed according to claim 1, wherein some of the loess bed units, which are located in a central region of the bed, centrally define an opening provided with a supporting rim portion, and a loess cover is inserted into the opening to close the opening.

6. The medical bed according to claim 1, wherein:

the bed frame is further provided with a wash water feed device; and the wash water feed device includes a supporting pedestal provided at a lower surface thereof with wheels, a vertical post extending upward from an upper surface of the supporting pedestal and provided at a certain position thereof with a shelf, an operating lever installed to an upper end of the vertical post to control the rate at which hot and cold water is supplied thereto, a shower member having a connection hose received in the vertical post to receive water from an external source, the shower member being extended outward from the operating lever so as to inject water from the connection hose, a storage container installed to the vertical post and configured to receive a predetermined level of wash water in an interior space thereof, and an injection hose to inject the wash water from the storage container.

7. The medical bed according to claim 1, wherein the lifting member is further provided with an electronic valve to control introduction of a hydraulic fluid into the lifting member, a pump to introduce the hydraulic fluid stored in a hydraulic fluid device into the lifting member, a controller to control opening/closing operations of the electronic valve and operation of the pump, and a timer to send a control signal to the controller at a predetermined time interval.

8. The medical bed according to claim 1, wherein each of the loess bed units is covered with a waterproof cover.

9. The medical bed according to claim 1, wherein a water discharge hole is perforated at an end position of the water collection unit.

10. The medical bed according to claim 1, wherein the angle adjustment unit includes a cylinder installed to the bed frame and provided with a piston rod, a link having one end coupled to the piston rod via a first hinge and the other end coupled to the bed frame via a second hinge, a supporting frame to support the link, the supporting frame internally defining a space in which a bearing is slidably installed at a position adjacent to the piston rod, and a third hinge installed to a surface of the bed frame to enable angular movement of the bed frame.

11. A medical bed comprising:

a bed frame defining an interior space, the bed frame being provided with legs each having a moving roller, a plurality of loess bed units, and separation preventive members provided at opposite lateral sides thereof to prevent separation of the loess bed units;

a support plate installed to each of the loess bed units to support the loess bed unit;

an upward or downward moving unit including a head portion attached to the support plate, a body portion extending downward from the head portion to guide upward or downward movement of the loess bed unit, and a pressure portion provided at a lower end of the body portion to apply pressure to the interior space of a lifting member, the upward or downward moving units being installed to the bed frame at a predetermined height from a bottom plane;

the lifting member fastened to a fixing die to vertically move the upward or downward moving unit and having inlet holes formed at upper and lower positions thereof, through which hydraulic fluid is introduced into or discharged from the lifting member;

a water collection unit located in the interior space of the bed frame and including a bottom plate inclined by a predetermined angle, the water collection unit being provided with wheels at four corners of a lower surface thereof; and an angle adjustment unit installed to the bed frame to enable angular movement of the bed frame.

12. The medical bed according to claim 11, wherein a rail unit is further installed in the interior space of the bed frame to guide sliding of the wheels of the water collection unit.

13. The medical bed according to claim 11, wherein the bed frame is further provided with a bath curtain.

14. The medical bed according to claim 11, wherein the bed frame is further provided with a blowing fan to facilitate blood circulation of the patient.

15. The medical bed according to claim 11, wherein some of the loess bed units, which are located in a central region of the bed, centrally define an opening provided with a supporting rim portion, and a loess cover is inserted into the opening to close the opening.

16. The medical bed according to claim 11, wherein:

the bed frame is further provided with a wash water feed device; and the wash water feed device includes a supporting pedestal provided at a lower surface thereof with wheels, a vertical post extending upward from an upper surface of the supporting pedestal and provided at a certain position thereof with a shelf, an operating lever installed to an upper end of the vertical post to control the rate at which hot and cold water is supplied thereto, a shower member having a connection hose received in the vertical post to receive water from an external source, the shower member being extended outward from the operating lever so as to inject water from the connection hose, a storage container installed to the vertical post and configured to receive a predetermined level of wash water in an interior space thereof, and an injection hose to inject the wash water from the storage container.

17. The medical bed according to claim 11, wherein the lifting member is further provided with electronic valves to control introduction of a hydraulic fluid into the lifting member, a pump to introduce the hydraulic fluid stored in a hydraulic fluid device into the lifting member, a controller to control opening/closing operations of the electronic valves and operation of the pump, and a timer to send a control signal to the controller at a predetermined time interval.

18. The medical bed according to claim 11, wherein each of the loess bed units is covered with a waterproof cover.

19. The medical bed according to claim 11, wherein a water discharge hole is perforated at an end position of the water collection unit.

20. The medical bed according to claim 11, wherein the angle adjustment unit includes a cylinder installed to the bed frame and provided with a piston rod, a link having one end coupled to the piston rod via a first hinge and the other end coupled to the bed frame via a second hinge, a supporting frame to support the link, the supporting frame internally defining a space in which a bearing is slidably installed at a position adjacent to the piston rod, and a third hinge installed to a surface of the bed frame to enable angular movement of the bed frame.

* * * * *